US008994282B1

(12) United States Patent
Peng

(10) Patent No.: US 8,994,282 B1
(45) Date of Patent: Mar. 31, 2015

(54) LIGHT EMITTING DIODE CONTROL CIRCUIT WITH SYNCHRONIZATION SIGNAL AND PACKAGE STRUCTURE FOR THE SAME AND SYSTEM FOR THE SAME

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 0 days.

(21) Appl. No.: 14/107,533

(22) Filed: Dec. 16, 2013

(51) Int. Cl.
*H05B 37/02* (2006.01)
*H05B 33/08* (2006.01)

(52) U.S. Cl.
CPC ..... *H05B 33/0842* (2013.01)
USPC ..... 315/201

(58) Field of Classification Search
CPC ..... H05B 37/029; H05B 37/02
USPC ..... 315/201
See application file for complete search history.

(56) References Cited

U.S. PATENT DOCUMENTS

| | | | | |
|---|---|---|---|---|
| 7,956,554 | B2 * | 6/2011 | Shteynberg et al. | 315/293 |
| 7,961,113 | B2 * | 6/2011 | Rabiner et al. | 340/4.21 |
| 8,134,299 | B2 * | 3/2012 | Peng | 315/192 |
| 2006/0022616 | A1 * | 2/2006 | Furukawa et al. | 315/309 |
| 2010/0013396 | A1 * | 1/2010 | Peng | 315/192 |

* cited by examiner

*Primary Examiner* — Douglas W Owens
*Assistant Examiner* — Pedro C Fernandez
(74) *Attorney, Agent, or Firm* — Muncy, Geissler, Olds & Lowe, P.C.

(57) ABSTRACT

A light emitting diode control circuit with synchronization signal includes a signal coupling unit, an operational amplifier, a synchronization and control logic unit, a light signal generating unit, an output logic unit and at least a current output unit. The synchronization and control logic unit sends a synchronization clock signal to the light signal generating unit. The light signal generating unit sends a light control signal to the output logic unit. According to the light control signal, the output logic unit is configured to control the current output unit to drive at least a light emitting diode.

8 Claims, 5 Drawing Sheets

LIGHT EMITTING DIODE CONTROL CIRCUIT WITH SYNCHRONIZATION SIGNAL AND PACKAGE STRUCTURE FOR THE SAME AND SYSTEM FOR THE SAME

BACKGROUND OF THE INVENTION

1. Field of the Invention

The present invention relates to a light emitting diode control circuit and package structure for the same and system for the same, and especially relates to a light emitting diode control circuit with synchronization signal and package structure for the same and system for the same.

2. Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards, and scenery designing.

The related art light emitting diode lamp string modules are commonly employed to be connected in series. Also, the amount of the light emitting diode lamp string modules is determined according to the volume of the decorated objects. In addition, all of the light emitting diode lamp string modules are controlled by the same controller which initially controls the first light emitting diode lamp string module.

Although the light emitting diode lamp string modules are easily connected together, the remaining light emitting diode lamp string modules behind the abnormal light emitting diode lamp string module cannot be lighted even only one of the light emitting diode lamp string modules is abnormal. That is because the control signal cannot be sent to drive all of the remaining light emitting diode lamp string modules.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

The remaining light emitting diode lamp string modules can still be normally controlled when one of the light emitting diode lamp string modules is abnormal. However, the amount of the control lines and the address lines increase proportionally. Therefore, complexity and the costs of the equipment also increase when the amount of the light emitting diode lamp string modules increases.

No matter the connection type of the light emitting diode lamp string modules is the serial-type or the parallel-type, many power transmission lines and signal transmission lines need to be used to control the colors and intensities of the light emitting diode lamp string modules. Accordingly, cost down can be achieved only if the amount of the power transmission lines or the signal transmission lines can be reduced.

SUMMARY OF THE INVENTION

In order to solve the above-mentioned problems, an object of the present invention is to provide a light emitting diode control circuit with synchronization signal.

In order to solve the above-mentioned problems, another object of the present invention is to provide a light emitting diode package structure with synchronization signal.

In order to solve the above-mentioned problems, still another object of the present invention is to provide a light emitting diode system with synchronization signal.

In order to achieve the object of the present invention mentioned above, the light emitting diode control circuit is applied to a power positive terminal, a power negative terminal and at least a light emitting diode. The light emitting diode control circuit includes a signal coupling unit, an operational amplifier, a synchronization and control logic unit, a light signal generating unit, an output logic unit and at least a current output unit. The signal coupling unit is electrically connected to the power positive terminal. The operational amplifier is electrically connected to the signal coupling unit and the power negative terminal. The synchronization and control logic unit is electrically connected to the operational amplifier and the power negative terminal. The light signal generating unit is electrically connected to the synchronization and control logic unit and the power negative terminal. The output logic unit is electrically connected to the light signal generating unit and the power negative terminal. The current output unit is electrically connected to the output logic unit and the light emitting diode. The synchronization and control logic unit sends a synchronization clock signal to the light signal generating unit. The light signal generating unit sends a light control signal to the output logic unit. According to the light control signal, the output logic unit is configured to control the current output unit to drive the light emitting diode.

In order to achieve other object of the present invention mentioned above, the light emitting diode package structure includes the light emitting diode control circuit mentioned above. The light emitting diode package structure further includes a first support, a first platform, a second support, a second platform, the light emitting diode and a package. The first platform is arranged at one side of the first support. The second support is arranged parallel to the first support. The second platform is arranged at one side of the second support. The light emitting diode control circuit is arranged on the second platform and is electrically connected to the second platform. The light emitting diode is arranged on the first platform and is electrically connected to the first platform. The light emitting diode control circuit is electrically connected to the light emitting diode. The package covers the first platform, the second platform, the light emitting diode control circuit and the light emitting diode.

In order to achieve other object of the present invention mentioned above, the light emitting diode system is applied to an alternating current power apparatus and an alternating current to direct current apparatus. The alternating current power apparatus sends an alternating current power to the alternating current to direct current apparatus. The alternating current to direct current apparatus rectifies the alternating current power into a rectified power. The alternating current to direct current apparatus sends the rectified power to the light emitting diode system. The light emitting diode system includes a plurality of the light emitting diode package structures mentioned above. The light emitting diode system further includes a carrier-synchronization signal generating unit and a transmission line. The carrier-synchronization signal generating unit is electrically connected to the alternating current to direct current apparatus and the light emitting diode package structure. The transmission line is electrically connected to the light emitting diode package structures. The carrier-synchronization signal generating unit detects a frequency of the rectified power to provide the synchronization and control logic unit to generate the synchronization clock signal. Therefore, the light emitting diodes in accordance with the light emitting diode control circuits are driven at the same time.

The efficiency of the present invention is to reduce the transmission lines of the light emitting diode lamp. Therefore, the cost of the light emitting diode lamp is reducing.

DETAILED DESCRIPTION OF THE INVENTION

Figure 1:
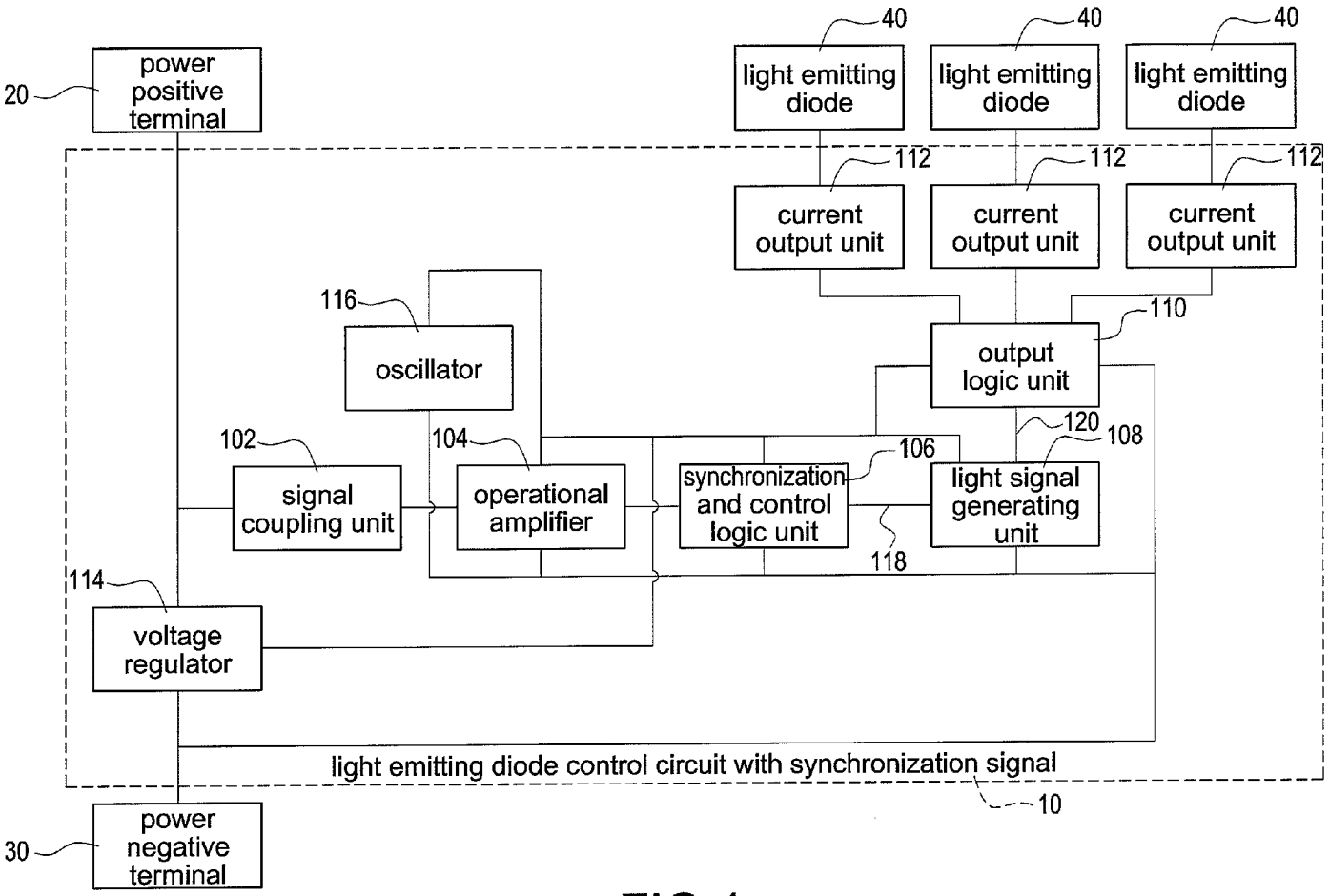
FIG. 1 shows a block diagram of the first embodiment of the light emitting diode control circuit of the present invention.

FIG. 1 shows a block diagram of the first embodiment of the light emitting diode control circuit of the present invention. A light emitting diode control circuit 10 with synchronization signal is applied to a power positive terminal 20, a power negative terminal 30 and at least a light emitting diode 40.

The light emitting diode control circuit 10 includes a signal coupling unit 102, an operational amplifier 104, a synchronization and control logic unit 106, a light signal generating unit 108, an output logic unit 110, at least a current output unit 112, a voltage regulator 114 and an oscillator 116.

The signal coupling unit 102 is electrically connected to the power positive terminal 20. The operational amplifier 104 is electrically connected to the signal coupling unit 102 and the power negative terminal 30. The synchronization and control logic unit 106 is electrically connected to the operational amplifier 104 and the power negative terminal 30. The light signal generating unit 108 is electrically connected to the synchronization and control logic unit 106 and the power negative terminal 30. The output logic unit 110 is electrically connected to the light signal generating unit 108 and the power negative terminal 30. The current output unit 112 is electrically connected to the output logic unit 110 and the light emitting diode 40. The voltage regulator 114 is electrically connected to the power positive terminal 20, the power negative terminal 30, the signal coupling unit 102, the operational amplifier 104, the synchronization and control logic unit 106, the light signal generating unit 108 and the output logic unit 110. The oscillator 116 is electrically connected to the voltage regulator 114 and the power negative terminal 30.

The synchronization and control logic unit 106 sends a synchronization clock signal 118 to the light signal generating unit 108. The light signal generating unit 108 sends a light control signal 120 to the output logic unit 110. According to the light control signal 120, the output logic unit 110 is configured to control the current output unit 112 to drive the light emitting diode 40.

Figure 2:
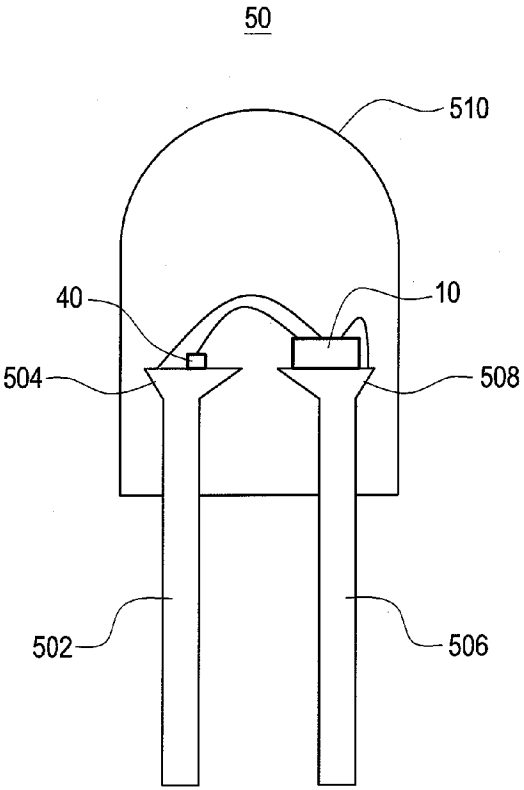
FIG. 2 shows a perspective view of the light emitting diode package structure of the present invention.

FIG. 2 shows a perspective view of the light emitting diode package structure of the present invention. A light emitting diode package structure 50 with synchronization signal includes the light emitting diode control circuit 10 mentioned above.

The light emitting diode package structure 50 further includes a first support 502, a first platform 504, a second support 506, a second platform 508, the light emitting diode 40 and a package 510.

The first platform 504 is arranged at one side of the first support 502. The second support 506 is arranged parallel to the first support 502. The second platform 508 is arranged at one side of the second support 506. The light emitting diode control circuit 10 is arranged on the second platform 508 and is electrically connected to the second platform 508. The light emitting diode 40 is arranged on the first platform 504 and is electrically connected to the first platform 504. The light emitting diode control circuit 10 is electrically connected to the light emitting diode 40. The package 510 covers the first platform 504, the second platform 508, the light emitting diode control circuit 10 and the light emitting diode 40.

Figure 3:
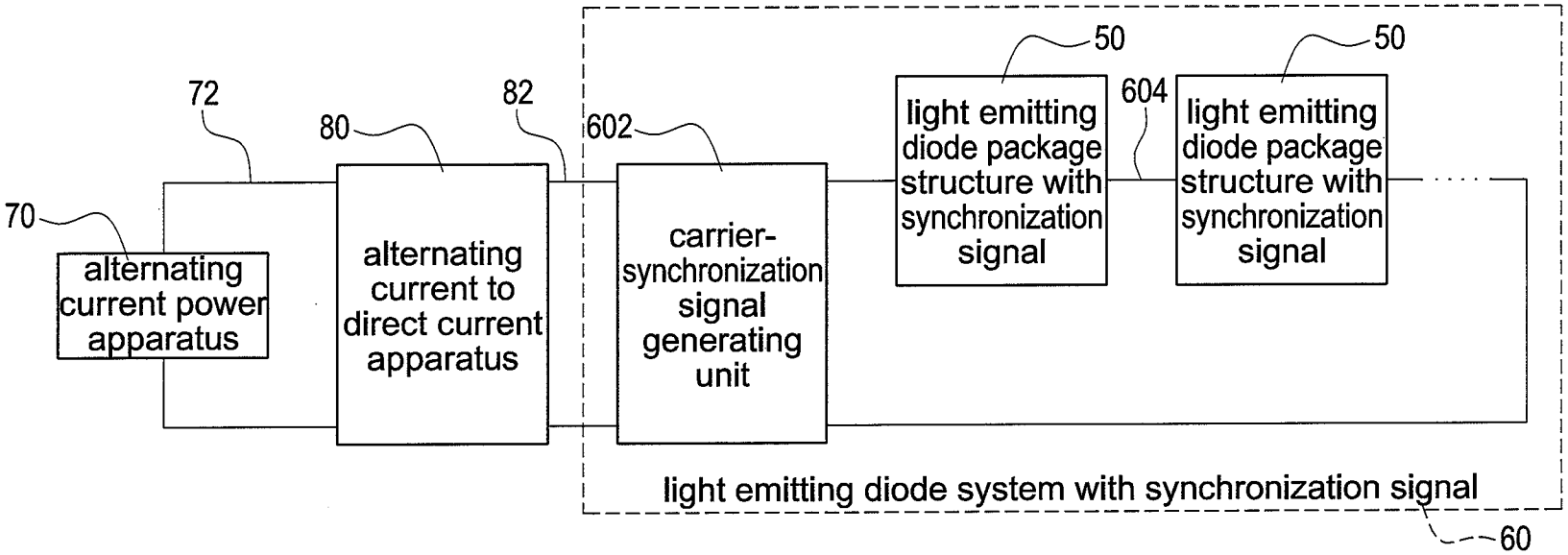
FIG. 3 shows a block diagram of the first embodiment of the light emitting diode system of the present invention.

FIG. 3 shows a block diagram of the first embodiment of the light emitting diode system of the present invention. A light emitting diode system 60 with synchronization signal is applied to an alternating current power apparatus 70 and an alternating current to direct current apparatus 80. The alternating current power apparatus 70 sends an alternating current power 72 to the alternating current to direct current apparatus 80. The alternating current to direct current apparatus 80 rectifies the alternating current power 72 into a rectified power 82. The alternating current to direct current apparatus 80 sends the rectified power 82 to the light emitting diode system 60.

The light emitting diode system 60 includes a plurality of the light emitting diode package structures 50 mentioned above. The light emitting diode system 60 further includes a carrier-synchronization signal generating unit 602 and a transmission line 604. The carrier-synchronization signal generating unit 602 is electrically connected to the alternating current to direct current apparatus 80 and the light emitting diode package structure 50. The transmission line 604 is electrically connected to the light emitting diode package structures 50.

The carrier-synchronization signal generating unit 602 detects a frequency (50~60 Hz) of the rectified power 82 to provide the synchronization and control logic unit 106 to generate the synchronization clock signal 118. Therefore, the light emitting diodes 40 in accordance with the light emitting diode control circuits 10 are driven at the same time.

Figure 4:
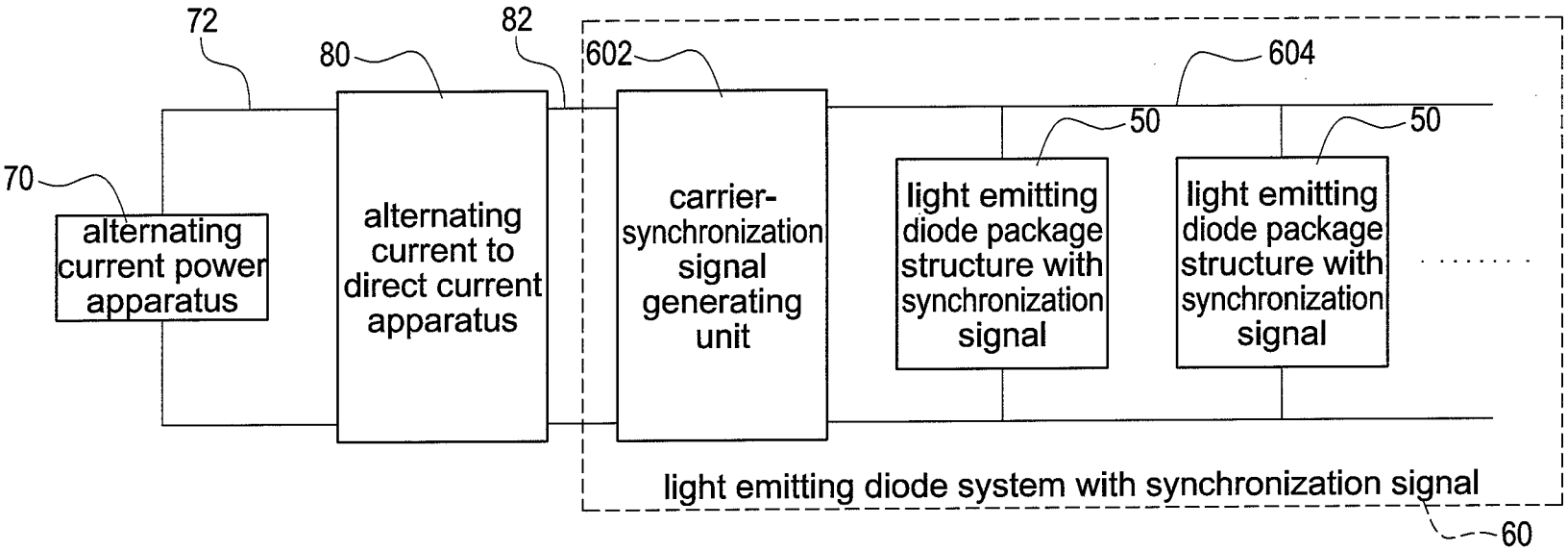
FIG. 4 shows a block diagram of the second embodiment of the light emitting diode system of the present invention.

FIG. 4 shows a block diagram of the second embodiment of the light emitting diode system of the present invention. The description for the elements shown in FIG. 4, which are similar to those shown in FIG. 3, is not repeated here for brevity. Moreover, the transmission line 604 in FIG. 3 is electrically connected to the light emitting diode package structures 50 in series. The transmission line 604 in FIG. 4 is electrically connected to the light emitting diode package structures 50 in parallel.

Figure 5:
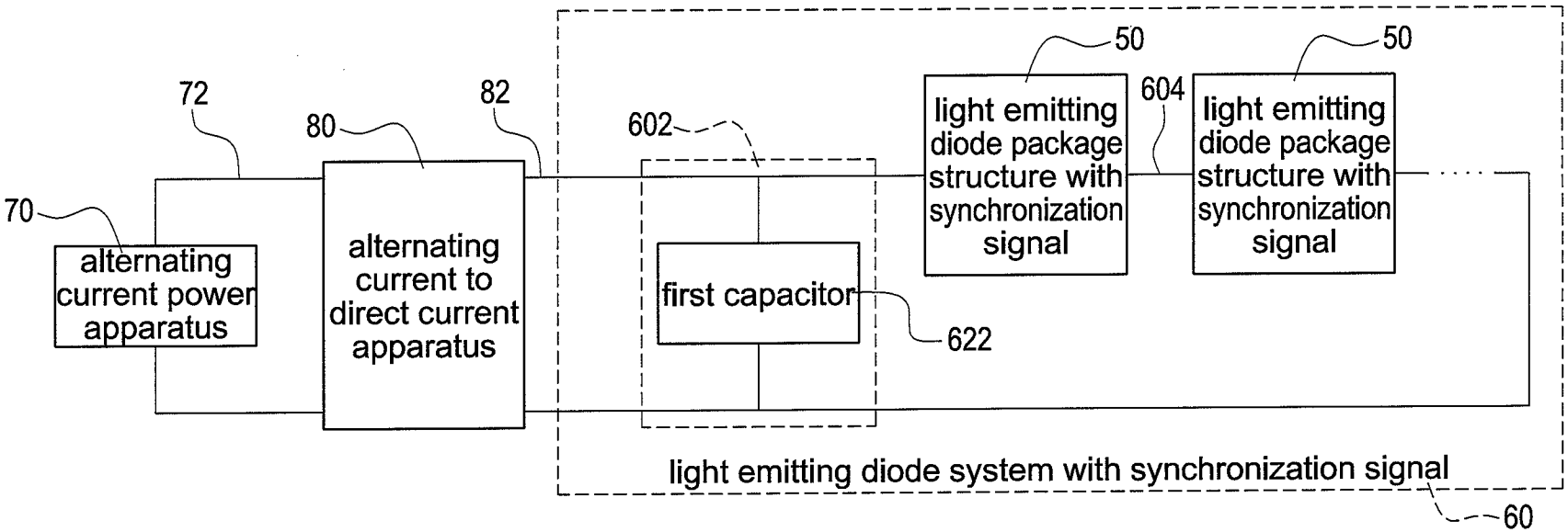
FIG. 5 shows a block diagram of the third embodiment of the light emitting diode system of the present invention.

FIG. 5 shows a block diagram of the third embodiment of the light emitting diode system of the present invention. The description for the elements shown in FIG. 5, which are similar to those shown in FIG. 3~4, is not repeated here for brevity. Moreover, the carrier-synchronization signal generating unit 602 includes a first capacitor 622. The first capacitor 622 is electrically connected to the alternating current to direct current apparatus 80 and the light emitting diode package structure 50.

The efficiency of the present invention is to reduce the transmission lines of the light emitting diode lamp. Therefore, the cost of the light emitting diode lamp is reducing.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode control circuit with synchronization signal, the light emitting diode control circuit applied to a power positive terminal, a power negative terminal and at least a light emitting diode, the light emitting diode control circuit comprising:

a signal coupling unit electrically connected to the power positive terminal;

an operational amplifier electrically connected to the signal coupling unit and the power negative terminal;

a synchronization and control logic unit electrically connected to the operational amplifier and the power negative terminal;

a light signal generating unit electrically connected to the synchronization and control logic unit and the power negative terminal;

an output logic unit electrically connected to the light signal generating unit and the power negative terminal; and at least a current output unit electrically connected to the output logic unit and the light emitting diode, wherein the synchronization and control logic unit sends a synchronization clock signal to the light signal generating unit; the light signal generating unit sends a light control signal to the output logic unit; according to the light control signal, the output logic unit is configured to control the current output unit to drive the light emitting diode.

2. The light emitting diode control circuit in claim 1, further comprising:

a voltage regulator electrically connected to power positive terminal, the power negative terminal, the signal coupling unit, the operational amplifier, the synchronization and control logic unit, the light signal generating unit and the output logic unit.

3. The light emitting diode control circuit in claim 2, further comprising:

an oscillator electrically connected to the voltage regulator and the power negative terminal.

4. A light emitting diode package structure with synchronization signal, the light emitting diode package structure comprising the light emitting diode control circuit in claim 3, the light emitting diode package structure further comprising:

a first support;

a first platform arranged at one side of the first support;

a second support arranged parallel to the first support;

a second platform arranged at one side of the second support, the light emitting diode control circuit arranged on the second platform and electrically connected to the second platform;

the light emitting diode arranged on the first platform and electrically connected to the first platform, the light emitting diode control circuit electrically connected to the light emitting diode; and a package covering the first platform, the second platform, the light emitting diode control circuit and the light emitting diode.

5. A light emitting diode system with synchronization signal, the light emitting diode system applied to an alternating current power apparatus and an alternating current to direct current apparatus, the alternating current power apparatus sending an alternating current power to the alternating current to direct current apparatus, the alternating current to direct current apparatus rectifying the alternating current power into a rectified power, the alternating current to direct current apparatus sending the rectified power to the light emitting diode system, the light emitting diode system comprising a plurality of the light emitting diode package structures in claim 4, the light emitting diode system further comprising:

a carrier-synchronization signal generating unit electrically connected to the alternating current to direct current apparatus and the light emitting diode package structure; and a transmission line electrically connected to the light emitting diode package structures, wherein the carrier-synchronization signal generating unit detects a frequency of the rectified power to provide the synchronization and control logic unit to generate the synchronization clock signal; therefore, the light emitting diodes in accordance with the light emitting diode control circuits are driven at the same time.

6. The light emitting diode system in claim 5, wherein the transmission line is electrically connected to the light emitting diode package structures in series.

7. The light emitting diode system in claim 5, wherein the transmission line is electrically connected to the light emitting diode package structures in parallel.

8. The light emitting diode system in claim 5, wherein the carrier-synchronization signal generating unit comprises a first capacitor electrically connected to the alternating current to direct current apparatus and the light emitting diode package structure.

* * * * *